United States Patent [19]

Smith et al.

[11] 4,157,083

[45] Jun. 5, 1979

[54] COMBINATION MANUAL AND POWER STARTER FOR ENGINES

[75] Inventors: LaVerne D. Smith, Wataga, Ill.; William H. Wulff, Cedar Grove, Wis.

[73] Assignee: Outboard Marine Corporation, Waukegan, Ill.

[21] Appl. No.: 803,765

[22] Filed: Jun. 6, 1977

[51] Int. Cl.[2] ..... F02W 17/00

[52] U.S. Cl. ..... 123/179 P; 74/625

[58] Field of Search ..... 123/179 P, 185 BA; 74/6, 625

[56] References Cited

U.S. PATENT DOCUMENTS

| | | | |
|---|---|---|---|
| 1,164,006 | 12/1915 | Mills | 123/179 P |
| 1,284,850 | 11/1918 | Aichele | 123/179 P |
| 1,415,531 | 5/1922 | Delano | 123/179 P |
| 1,502,018 | 7/1924 | Chiton | 74/6 |
| 2,483,950 | 10/1949 | Watson et al. | 74/625 |
| 2,939,448 | 6/1960 | Hansen | 123/179 P |
| 3,219,021 | 11/1965 | Mercer et al. | 123/179 P |
| 3,383,948 | 5/1968 | Palmer et al. | 74/625 |

*Primary Examiner*—Charles J. Myhre
*Assistant Examiner*—David D. Reynolds
*Attorney, Agent, or Firm*—Michael, Best & Friedrich

[57] ABSTRACT

Disclosed herein is a starter mechanism for an engine having a starter gear, which starter mechanism includes a rotatable starter shaft, a starter pinion rotatably mounted on the starter shaft for axial movement, in response to rotation of the starter shaft in one direction, to an engine starting position in driving engagement with the engine starter gear, and a drive member mounted for rotation coaxially with the starter shaft and drivingly connected to the starter shaft. Manual starting of the engine is selectively effected by rotating a circular member or rotor drivingly connected to the drive member through a first one-way clutch which, in response to rotation of the rotor in the one direction, affords common rotary movement of the rotor and the drive member and permits free wheeling of the drive member relative to the rotor in the same direction when the rotor is not operated. Powered starting of the engine is selectively effected, independently of the manual starter, by a power unit including a driven gear mounted coaxially with the drive member and drivingly connected to the drive member through a second one-way clutch which, in response to operation of the power unit, affords common rotary movement of the drive gear and the drive member in the one direction and which permits free wheeling of the drive member relative to the driven gear in the same direction when the power unit is not operated.

15 Claims, 2 Drawing Figures

COMBINATION MANUAL AND POWER STARTER FOR ENGINES

BACKGROUND OF THE INVENTION

The invention relates to starter mechanisms for internal combustion engines and, more particularly, to such starter mechanisms which are selectively operable to facilitate manual or powered engine starting.

Starter mechanisms for internal combustion engines, such as engines used on power mowers, have been arranged so that the engine can be started either manually or by a power drive unit. Examples of prior art constructions for this type starter mechanism are disclosed in the following U.S. Pat. Nos.

Hansen 2,939,448 issued June 7, 1960;

Mercer et al 3,219,021 issued Nov. 23, 1965.

SUMMARY OF THE INVENTION

The invention provides a starter mechanism for an engine having a starter gear, which starter mechanism includes a starter shaft mounted for rotation relative to a starter housing, a starter pinion, means rotatably mounting the starter pinion on the starter shaft for axial movement, in response to rotation of the starter shaft in one direction, from a retracted position to an engine starting position in driving engagement with the engine starting gear, a drive member mounted for rotation coaxially with the starter shaft and drivingly connected to the starter shaft, first and second drive means selectively operable for rotating the drive member in the one direction to start the engine, first one-way clutch means connecting the first drive means with the drive member for rotating the drive member in the one direction in response to operation of the first drive means and for permitting free wheeling of the drive member relative to the first drive means in the one direction when the first drive means is not operated, and second one-way clutch means connecting the second drive means with the drive member for rotating the drive member in the one direction in response to operation of the second drive means and for permitting free wheeling of the drive member relative to the second drive means in the one direction when the second drive means is not operated.

In one embodiment, the starter mechanism includes a stationary shaft mounted on the starter housing, the drive member includes a hub portion rotatably mounted on the stationary shaft, and the first drive means includes a manually operable rotor drivingly connected to the drive member hub portion through the first one-way clutch means.

In one embodiment, the second drive means includes a power drive means having a drive shaft carrying a drive gear and a driven gear mounted for rotation coaxially with the drive member and drivingly connecting to the drive member hub portion through the second one-way clutch means.

In one embodiment, the manually operable rotor includes a circular member and a starter rope wound on the circular member with one end affixed to the circular member and having a free end which is pulled to rotate the circular member.

In one embodiment, the power drive means is an electric motor.

In one embodiment, the drive member is drivingly connected to the starter shaft through slip clutch means for rotating the starter shaft in the one direction in response to rotation of the drive member either by the first drive means or by the second drive means and for permitting the drive member to rotate relative to the starter shaft when the torque on the starter pinion exceeds a predetermined value.

A principal features of the invention is the provision of a compact engine starter mechanism including separate drive means which are independently and selectively operable to initiate engine starting.

Another principal feature of the invention is the provision of such engine starter mechanism wherein one of the drive means is manually operable and the other drive means is power operated.

A further principal feature of the invention is the provision of an engine starter mechanism including a rotatable drive member drivingly connected to a starter pinion, a manually operable rotor drivingly connected to the drive member through a first one-way clutch which, in response to rotation of the rotor in one direction, affords common rotary movement of the rotor and the drive member and which permits free wheeling of the drive member relative to the rotor in the same direction, and a power drive means having a driven gear drivingly connected to the drive member through a second one-way clutch which, in response to operation of the power drive means, affords common rotary movement of the driven gear and the drive member in the one direction and which permits free wheeling of the drive member relative to the driven gear.

Other features, aspects and advantages of the embodiments of the invention will become apparent to those skilled in the art upon reviewing the following detailed description, the drawing and the appended claims.

Figure 1:
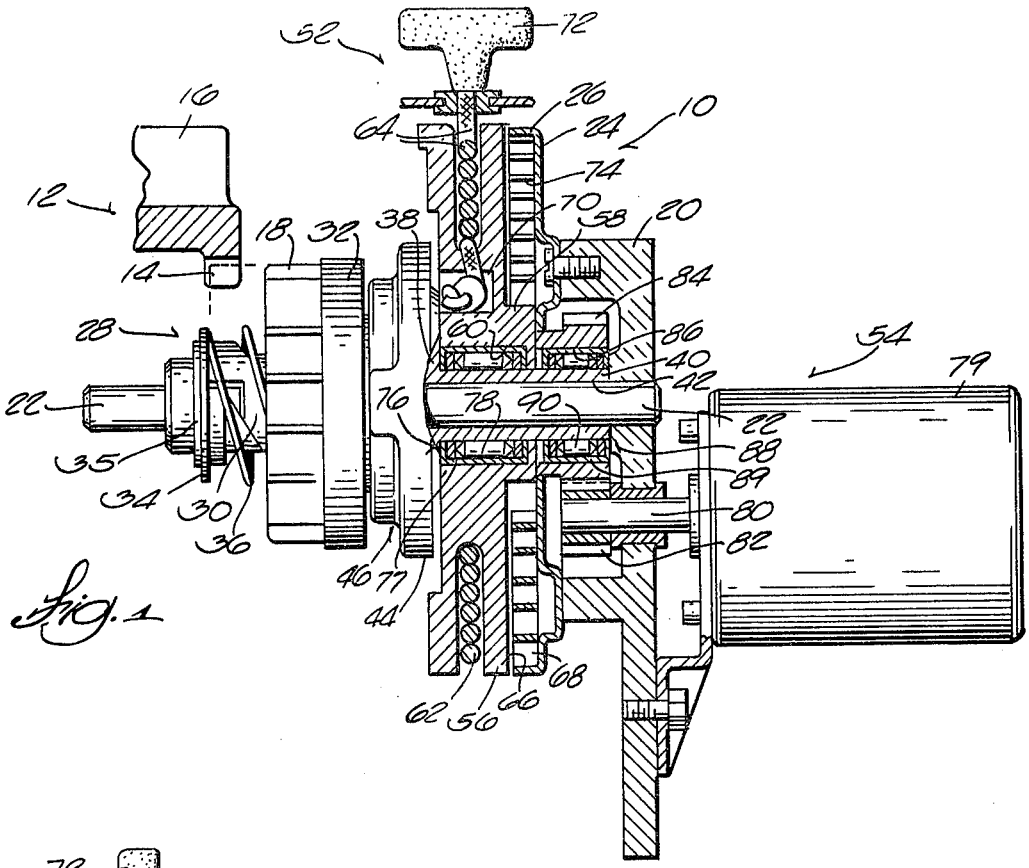
FIG. 1 is a side elevation view, partially in section, of an engine starter mechanism embodying various of the features of the invention.

Before explaining at least one embodiment of the invention in detail, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

DESCRIPTION OF THE PREFERRED EMBODIMENTS

Illustrated in the drawing is a starter mechanism 10 for an engine 12 which is illustrated fragmentarily and includes a rotary starter gear 14 which can be part of a flywheel 16. The starter mechanism 10 is operative to selectively engage and rotate the starter gear 14 so to start the engine 12.

While various starter mechanism constructions can be used, in the specific construction illustrated, the starter mechanism 10 is fixed relative to the engine 12 and includes a starter pinion 18 which is meshable with the starter gear 14 and first and second drive means which are selectively and independently operable for rotating the starter pinion 18 and for axially displacing the starter pinion 18, in response to rotation thereof, from a retracted position axially spaced from the starter gear 14 to an advance or engine starting position in meshing or driving engagement with the starter gear 14.

More specifically, the starter mechanism 10 includes a frame or housing 20 which is fixed relative to the engine 12, a generally centrally located stationary shaft 22 mounted on the housing 20, and a cylindrical frame or housing member 24 having a circular flange 26. Rotatably mounted on the stationary shaft 22 is a starter shaft 28 including a helical drive worm gear 30 on which the starter pinion 18 is carried for relative axial and rotary movement in the usual manner. The starter pinion 18 includes a circular disc 32 for inertially restraining rotation of the starter pinion 18 relative to the starter shaft 28 during initial rotation of the starter shaft 28 as described below.

Interposed a retainer ring 34 contained by a retainer member 35 mounted on the outer end portion of the starter shaft 28 and the starter pinion 18 and disposed in encircling relation to the drive worm 30 is a helical compression spring 36 which serves to limit axial advance of the starter pinion 18 toward the starter gear 14 and to assist in returning the starter pinion 18 toward the retracted position after the engine 12 is started.

Rotatably mounted on the stationary shaft 22 for coaxial rotation with the starter shaft 28 is a drive member 38 including a hub portion 40 having a central bore 42 rotatably receiving the stationary shaft 22 and a circular disc 44 extending radially outwardly from the hub portion 40 generally adjacent the circular disc 32 on the starter pinion 18. The starter shaft 28 and circular disc 44 are drivingly connected together for rotation of the starter shaft 28, in response to rotation of the drive member 38 in one direction, through a conventional slip clutch arrangement 46 (illustrated diagrammatically).

The slip clutch arrangement 46 is of the type which provides driving engagement of the circular disc 44 and the starter shaft 28 and thus common rotary movement of the drive member 38 and the starter shaft 28, when the drive member 38 is rotated in one direction (in the clockwise direction as viewed in FIG. 2) and permits the drive member 38 to rotate relative to the starter shaft 28 in that direction when the torque or load on the starter pinion 18 exceeds a predetermined value. Various conventional slip clutch arrangements can be used and the specific construction thereof does not form part of the invention. Accordingly, illustration and a detailed description of same is not deemed necessary for a full understanding of the invention.

The drive member 38 is rotated either by a manually operated unit 52 or by a power driven unit 54, which units are selectively operable to facilitate manual or powered starting of the engine 22 as the need requires.

More specifically, the manually operated unit 52 includes a rotor or circular member or pulley 56 rotatably carried coaxially with the drive member hub portion 40. The pulley 56 includes a hub 58 having a central bore 60 rotatably receiving the drive member hub portion 40 and a peripheral groove 62 adapted to receive several coils of a pull rope 64. One face 66 of the pulley 56 is located in a spaced opposing relation to the housing member 24 and cooperates therewith to define a spring chamber 68. The pulley 56 also includes a pocket 70 adapted to receive the enlarged inner end of the pull rope 64 so as to anchor the inner end of the pull rope 64 adjacent the radially inner part of the peripheral groove 62.

The pull rope 64 includes a handle 72 and is normally wound on the pulley 56 by a recoil or rewind spring 74 located in the spring chamber 68 with one end anchored to the housing member 24 and the other end anchored to the pulley 56. In the specific construction illustrated, the pull rope 64 is wound clockwise on the pulley 56 and the rewind spring 74 is wound counterclockwise as viewed in FIG. 2.

The pulley 56 is drivingly connected to the drive member 38 through a conventional one-way clutch arrangement 76 (illustrated diagrammatically) located between the pulley bore 60 and the drive member hub portion 40. The one-way clutch arrangement 76 is of the type which provides driving engagement between the pulley bore 60 and the drive member hub portion 40, and thus common rotary movement of the pulley 56 and the drive member 38, when the pulley 56 is rotated in one direction (in the clockwise direction as viewed in FIG. 2) and permits free wheeling of the drive member hub portion 40 relative to the pulley 56 in the same direction of rotation when the pulley 56 is not being rotated. The one-way clutch arrangement 76 includes a driving clutch element 77 operatively connected to the pulley bore 60 and a driven clutch element 78 operatively connected to the drive member hub portion 40. Various conventional one-way clutch arrangements of this type can be used and the specific construction thereof does not form a part of the invention. Accordingly, illustration and the detailed description of same is not deemed necessary for a full understanding of the invention.

Figure 2:
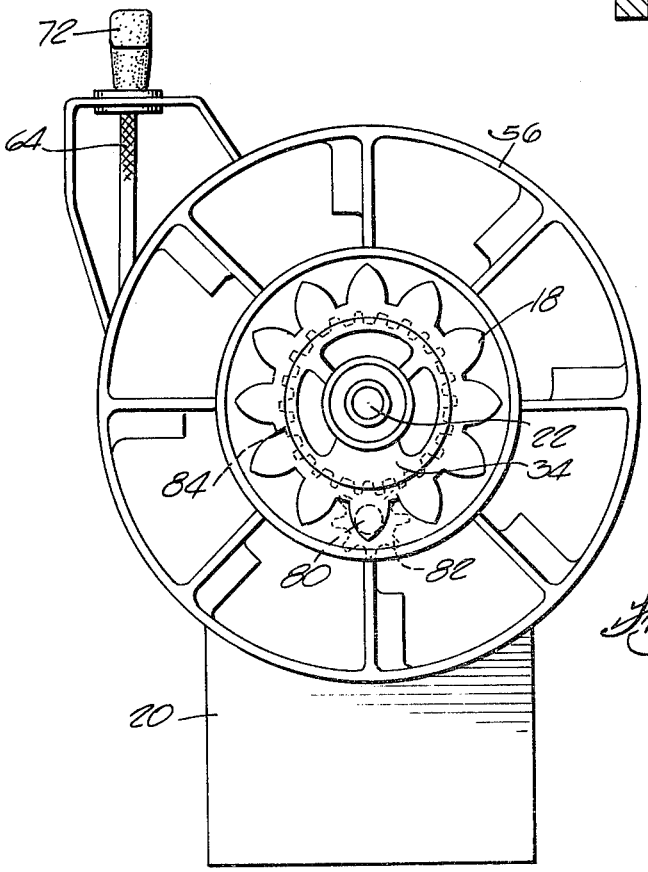
FIG. 2 is a left end view of the starter mechanism in FIG. 1.

When the pull rope 64 is pulled to manually initiate engine starting, the pulley 56 rotates in the clockwise direction as viewed in FIG. 2 and the rewind spring 74 is coiled or wound. When the pull rope 64 is released, the rewind spring 74 is uncoiled or unwound and serves to rotate the pulley 56 in the counterclockwise direction so as to rewind the pull rope 64 into the pulley 56. The one-way clutch arrangement 76 permits counterclockwise rotation of the pulley 56 relative to the drive member hub portion 40. In response to the clockwise rotation of the pulley 56 during pulling of the pull rope 64, the drive member 38 is rotated in the clockwise direction via the one-way clutch arrangement 76 and in turn the starter shaft 28, and thus the drive worm 30, is rotated in a clockwise direction via the slip clutch arrangement 46.

During this clockwise rotation of the drive worm 30, the circular disc 32 inertially restrains rotation of the starter pinion 18 causing the starter pinion 18 to travel axially on the drive worm 30 from the retracted position to the advanced starter gear engagement position while compressing the return spring 36. The starter pinion 18 meshes with the starter gear 14 and rotates with the drive worm 30 to drive the starter gear 14 and thereby start the engine 12. When the engine starts, rotation of the flywheel 16 with an assist by the return spring 36 causes the starter pinion 18 to travel axially on the drive worm from the advanced starter gear engagement position to the retracted position.

The power driven unit 54 includes an electric motor 79 which is suitably supported adjacent the end of the housing 20 opposite to the starter pinion 18. The electric motor 79 includes a drive shaft 80 rotatably extending into the housing 20 and carrying a pinion or drive gear 82 located inside the housing 20. Rotatably carried coaxially with the drive member hub portion 40 at a location axially spaced from the pulley 56 is a driven gear 84 which meshes with the drive gear 82 and includes a central bore 86 rotatably receiving the drive member hub portion 40.

The driven gear 84 is drivingly connected to the drive member 38 through a conventional one-way clutch arrangement 88 (illustrated diagrammatically) located between the driven gear 86 and the drive member hub portion 40. The one-way clutch arrangement 88 is the same type as the one-way clutch arrangement 76 and for the same reasons given above is not illustrated and described in detail. The one-way clutch arrangement 88 provides driving connection between the driven gear bore 86 and the drive hub portion 40, and thus common rotary movement of the driven gear 84 and the drive member 38, when the driven gear 84 is rotated in the clockwise direction as viewed in FIG. 2 and permits free wheeling of the drive member hub portion 44 in the clockwise direction when the driven gear 84 is not being rotated. The one-way clutch arrangement 88 includes a driving clutch element 89 operatively connected to the driven gear bore 86 and a driven clutch element 90 operatively connected to the drive member hub portion 40.

When the electric motor 79 is operated to initiate engine starting, the drive gear 82 rotates the driven gear 84 in the clockwise direction. In response to clockwise rotation of the driven gear 84, the drive member 38 is rotated clockwise via the one-way clutch arrangement 88 and in turn the starter shaft 28, and thus the drive worm 30, is rotated in the clockwise direction via the slip clutch arrangement 46 to start the engine 12 as described above.

During operation of the electric motor 79, the one-way clutch arrangement 76 permits free wheeling of the drive member 38 relative to the pulley 56 in the clockwise direction, thereby isolating the power or electric start system from the manual start system. Likewise, the one-way clutch arrangement 88 permits free wheeling of the drive member 38 relative to the drive gear 84 in the clockwise direction, thereby isolating the manual start system from the power or electric start system.

From the above description, it can be seen that the starter mechanism 10 provided by the invention incorporates both a manual start system and a power start system into a single compact assembly. Also, simple drive means are employed for selectively isolating one system from the other, thereby reducing fabrication and maintenance costs.

It is within the scope of the invention to replace the electric motor 79 with an external coupling on the drive shaft 80 adapted for temporary connection with a separate power source such as an electric hand drill or the like.

Various of the features of the invention are set forth in the following claims:

What is claimed is:

1. A starter mechanism for an engine having a starter gear, said starter mechanism comprising a starter housing fixed relative to the engine, a starter shaft mounted for rotation relative to said starter housing, a starter pinion, means rotatably mounting said starter pinion on said starter shaft for axial movement, in response to rotation of said starter shaft in one direction, from a retracted position to an engine starting position in driving engagement with the starter gear, a drive member mounted for rotation coaxially with said starter shaft and drivingly connected to said starter shaft, first and second drive means selectively operable for rotating said drive member in said one direction to start the engine, first one-way clutch means on said drive member connecting said first drive means with said drive member for rotating said drive member in said one direction in response to operation of said first drive means and for permitting free wheeling of said drive member relative to said first drive means in said one direction when said first drive means is not operated, and second one-way clutch means on said drive member connecting said second drive means with said drive member for rotating said drive member in said one direction in response to operation of said second drive means and for permitting free wheeling of said drive member relative to said second drive means in said one direction when said second drive means is not operated.

2. A starter mechanism according to claim 1 wherein said first drive means includes a manually operable rotor drivingly connected to said drive member through said first one-way clutch means.

3. A starter mechanism according to claim 2 wherein said manually operable rotor includes a circular member, and a starter rope wound on said circular member and having one end affixed to said circular member and having a free end which is pulled to rotate said circular member.

4. A starter mechanism according to claim 2 wherein said starter mechanism includes a stationary shaft mounted on said starter housing, wherein said drive member includes a hub portion rotatably carried coaxially with said stationary shaft, wherein said manually operable rotor has a bore rotatably receiving said drive member hub portion, and wherein said first one-way clutch means includes a driving clutch element operatively connected to said rotor bore and a driven clutch element complementary to said driving clutch element and operatively connected to said drive member hub portion.

5. A starter mechanism according to claim 1 wherein said second drive means includes a power drive means having a drive shaft drivingly connected to said drive member through said second one-way clutch means.

6. A starter mechanism according to claim 5 wherein said power drive means is an electric motor.

7. A starter mechanism according to claim 5 wherein said second drive means further includes a drive gear mounted on said drive shaft and a driven gear mounted for rotation coaxially with said drive member and meshing with said drive gear, and wherein said second one-way clutch means includes a driving clutch element operatively connected to said driven gear and a driven clutch element complementary to said driving clutch element and operatively connected to said drive member.

8. A starter mechanism according to claim 7 wherein said starter mechanism includes a stationary shaft mounted on said housing, wherein said drive member includes a hub portion rotatably mounted on said stationary shaft, wherein said driven clutch element is operatively connected to said drive member hub portion, wherein said driven gear includes a bore rotatably receiving said drive member hub portion, and wherein said driving clutch element is operatively connected to said driven gear bore.

9. A starter mechanism according to claim 1 wherein said drive member is drivingly connected to said starter shaft through slip clutch means for rotating said starter shaft in said one direction in response to rotation of said drive member either by said first drive means or by said second drive means and for permitting said drive member to rotate relative to said starter shaft when the torque on said starter pinion exceeds a predetermined value.

10. A starter mechanism for an engine having a rotary starter gear, said starter mechanism comprising a starter housing fixed relative to the engine, a starter shaft mounted for rotation relative to said starter housing, a starter pinion, means rotatably mounting said starter pinion on said starter shaft for axial movement, in response to rotation of said starter shaft, from a retracted position to an engine starting position in driving engagement with the starter gear, a stationary shaft mounted on said housing, a drive member mounted on said stationary shaft for rotation coaxially with said starter shaft and drivingly connected to said starter shaft, first and second drive means selectively operable for rotating said drive member to start the engine, said first drive means including a manually operable rotor mounted for rotation coaxially with said drive member, said second drive means including a power drive means having a drive shaft, a drive gear carried on said drive shaft, and a driven gear mounted for rotation coaxially with said drive member and meshing with said drive gear, first one-way clutch means on said drive member connecting said rotor with said drive member for rotating said drive member in said one direction in response to rotation of said rotor and for permitting free wheeling of said drive member relative to said rotor in said one direction when said rotor is not operated, and second one-way clutch means on said drive member and axially spaced from said first one-way clutch means connecting said driven gear with said drive member for rotating said drive member in said one direction in response to operation of said power drive means and for permitting free wheeling of said drive member relative to said driven gear in the said one direction when said power drive means is not operated.

11. A starter mechanism according to claim 10 wherein said drive member is drivingly connected to said starter shaft by slip clutch means for rotating said starter shaft in said one direction in response to rotation of said drive member either by operation of said rotor or by operation of said power drive means and for permitting said drive member to rotate relative to said starter shaft when the torque on said starter pinion exceeds a predetermined value.

12. A starter mechanism according to claim 11 wherein said power drive means is an electric motor, and said rotor includes a circular member and a starter rope wound on said circular member and having one end affixed to said circular member and a free end which is pulled to rotate said circular member.

13. A starter mechanism for an engine having a starter gear, said starter mechanism comprising a starter housing fixed relative to the engine, a starter shaft mounted for rotation relative to said starter housing, a starter pinion, means rotatably mounting said starter pinion on said starter shaft for axial movement, in response to rotation of said starter shaft in one direction, from a retracted position to an engine starting position in driving engagement with the starter starting gear, a stationary shaft mounted on said starter housing, a drive member having a hub portion mounted on said stationary shaft for rotation coaxially with said starter shaft and drivingly connected to said starter shaft, first and second drive means selectively operable for rotating said drive member in said one direction to start the engine, said first drive means including a manually operable motor having a bore rotatably receiving said drive member hub portion, first one-way clutch means including a driving clutch element operably connected to said rotor bore and a driven clutch element complementary to said driving clutch element and operatively connected to said drive member hub portion for rotating said drive member in said one direction in response to rotation of said rotor and for permitting free wheeling of said drive member relative to said rotor in said one direction when said rotor is not operated, and second one-way clutch means connecting said second drive means with said drive member for rotating said drive member in said one direction in response to operation of said second drive means and for permitting free wheeling of said drive member relative to said second drive means in said one direction when said second drive means is not operated.

14. A starter mechanism according to claim 13 wherein said second drive means includes a power drive means having a drive shaft, a drive gear mounted on said drive shaft, and a driven gear mounted for rotation coaxially with said drive member and meshing with said drive gear and wherein said second one-way clutch means includes a driving clutch element operatively connected to said driven gear and a driven clutch element complementary to said driving clutch element and operatively connected to said drive member.

15. A starter mechanism according to claim 14 wherein said driven clutch element of said second one-way clutch means is operatively connected to said drive member hub portion, wherein said driven gear includes a bore rotatably receiving said drive member hub portion, and wherein said driving clutch element of said second one-way clutch means is operatively connected to said driven gear bore.

* * * * *